US008700220B2

(12) United States Patent
Ocondi et al.

(10) Patent No.: US 8,700,220 B2
(45) Date of Patent: Apr. 15, 2014

(54) METHODS AND APPARATUSES FOR OPTIMIZING WELLS

(75) Inventors: Cham Ocondi, Aurora, CO (US); Gary E. Hughes, Denver, CO (US)

(73) Assignee: WIXXI Technologies, LLC, Castle Rock, CO (US)

( * ) Notice: Subject to any disclaimer, the term of this patent is extended or adjusted under 35 U.S.C. 154(b) by 297 days.

(21) Appl. No.: 12/876,947

(22) Filed: Sep. 7, 2010

(65) Prior Publication Data

US 2011/0060472 A1 Mar. 10, 2011

Related U.S. Application Data

(60) Provisional application No. 61/240,549, filed on Sep. 8, 2009.

(51) Int. Cl.
*G05D 7/00* (2006.01)

(52) U.S. Cl.
USPC ..... 700/282

(58) Field of Classification Search
USPC ..... 700/282; 166/54, 68, 107
See application file for complete search history.

(56) References Cited

U.S. PATENT DOCUMENTS 4,664,602 A * 5/1987 Gordon ..... 417/56
5,146,991 A 9/1992 Rogers
5,878,817 A * 3/1999 Stastka ..... 166/372
5,896,924 A 4/1999 Carmody et al.
5,957,200 A * 9/1999 Majek et al. ..... 166/250.15
5,983,164 A 11/1999 Ocondi
6,196,324 B1 * 3/2001 Giacomino et al. ..... 166/372
6,241,014 B1 * 6/2001 Majek et al. ..... 166/53
6,595,294 B1 * 7/2003 Dalsmo et al. ..... 166/369
6,598,675 B2 * 7/2003 Bussear et al. ..... 166/250.15
6,634,426 B2 * 10/2003 McCoy et al. ..... 166/254.1
6,873,267 B1 * 3/2005 Tubel et al. ..... 340/853.3
6,883,606 B2 * 4/2005 Evans et al. ..... 166/250.15
7,219,725 B2 * 5/2007 Chisholm ..... 166/68
7,823,640 B2 * 11/2010 Flanders ..... 166/250.01
7,950,464 B2 * 5/2011 Atencio et al. ..... 166/360
7,957,841 B2 * 6/2011 Zarowny et al. ..... 700/282
2006/0054329 A1 * 3/2006 Chisholm ..... 166/372
2006/0225888 A1 * 10/2006 Reitz ..... 166/370

(Continued)

OTHER PUBLICATIONS

Presentation entitled "Software to Optimize Gas Well Production", for the Gas Well Deliquification Workshop, first presented at least as early as Feb. 27, 2006; (28 pages).
Foss, et al., "Plunger-Lift Performance Criteria with Operating Experience—Ventura Avenue Field", Drilling and Production Practices, 1965, API, pp. 124-140.

(Continued)

*Primary Examiner* — Mohammad Ali
*Assistant Examiner* — Sivalingam Sivanesan
(74) *Attorney, Agent, or Firm* — Dorsey & Whitney LLP

(57) ABSTRACT

Methods and apparatuses are disclosed for optimizing oil and gas wells. Some embodiments may include optimizing a gas well based upon continuous measurements of the well's operating parameters, such as casing pressure draw down and/or line pressure surges. These continuous measurements of the well's parameters may be utilized to derive an empirical model of the well's behavior that is more accurate than conventional approaches with respect to the various stages of well production. In other words, by measuring the well's operating parameters continuously and measuring certain well parameters (like casing pressure draw down and/or surges in line pressure from opening the well), the empirical model derived therefrom may provide more accurate control of turn on criteria of the well than conventional approaches, such as during the mature production stage of production of the well.

20 Claims, 6 Drawing Sheets

(56) References Cited

U.S. PATENT DOCUMENTS

| | | | | |
|---|---|---|---|---|
| 2007/0012442 | A1 | 1/2007 | Hearn | |
| 2010/0051110 | A1 | 3/2010 | Ocondi | |
| 2010/0101774 | A1 | 4/2010 | Ocondi et al. | |
| 2011/0061861 | A1 * | 3/2011 | Flanders | 166/250.01 |

OTHER PUBLICATIONS

Morrow, et al., "Plunger-Lift: Automated Control Via Telemetry", http://www.fergusonbeauregard.com/downloads/plunger-lift-automated-control.pdf 2000, pp. 1-6.

"Plunger-Lift Systems", http://www.fergusonbeauregard.com/pdf/Plunger-lift-brochure.pdf, pp. 1-4.

* cited by examiner

METHODS AND APPARATUSES FOR OPTIMIZING WELLS

CROSS-REFERENCE TO RELATED APPLICATIONS

The application claims priority from U.S. Provisional Application entitled, "Methods and Apparatuses Optimizing Well Production," filed on Sep. 8, 2009. This application is related to and incorporates by reference commonly owned U.S. patent application Ser. No. 12/260,907 titled MEASUREMENT AND CONTROL OF LIQUID LEVEL IN WELLS, which was filed on Oct. 29, 2008. This application is related to and incorporates by reference commonly owned U.S. patent application Ser. No. 12/552,630 titled GAS ACTUATED VALVE, which was filed on Sep. 2, 2009.

BACKGROUND OF THE INVENTION

I. Technical Field

The present invention relates generally to wells, and more particularly to methods and apparatuses that optimize oil and gas wells.

II. Background Discussion

Oil and gas wells are ubiquitous in the petrochemical industry. At various stages in the life of a well, the quantity and/or quality of production may change over time. Early in the life of a gas producing well, sometimes referred to as the "initial production" stage, there may be plenty of downhole pressure and the gas produced from the well may be substantially dry such that there is little need to separate the gas from liquids such as oil and water.

In the next stage of a gas producing well, sometimes referred to as the "early liquid loading" stage, the downhole pressure may decline from the initial production stage and the well may begin to produce liquids, such as oil and water, in a mist form along with the gas. Gradually, this liquid in the well may build up to a point where the amount of liquid in the well, sometimes referred to as the "liquid load", is such that it overcomes the downhole pressure in the well and the well ceases production. In an attempt to prevent the well from loading up with liquids to the point that the well ceases production, gas may be produced intermittently from the well by opening and closing a valve in the gas production line (sometimes referred to as "shutting in" the well). The idea being that shutting in the well for a period of time may allow a sufficient downhole pressure to build up and overcome the liquid load in the well. Also, in an attempt to prevent the well from loading up with liquids, a plunger-type lift system may be implemented in the well, such that when the well is reopened, the built up downhole pressure may use the plunger to lift the fluid from the well.

Some conventional approaches attempt to maximize gas production during the early liquid loading stage by timing the well to be off for a certain period of time. In some cases, the period of time during which the well is shut in for is adjusted by the well's operator based upon the operator's familiarity with that particular well's characteristics. While timing the well to be off for a period of time may aid in optimizing well production during the early liquid loading stage, this optimization may rely too heavily on the skill of the well operator in adjusting this period of time.

Also, some conventional approaches attempt to maximize gas production during the early liquid loading stage by shutting the well "in" based upon the speed at which the plunger moves within the well. The idea being that, after the well is "shut in" for a sufficiently long period of time to build up downhole pressure, the plunger will be at the bottom of the well and travel to the top at substantially the same speed as the liquid being cleared from the well. For example, many conventional approaches control the frequency and duration of well shut in such that the plunger speed is in the range of 600-700 feet per minute. Unfortunately, if the plunger never reaches the bottom of the well during the shut in period, then the calculated plunger speed calculation may be inaccurate causing this well optimization scheme to be inaccurate.

In the final stage of production, sometimes referred to as the "mature" stage, the gas produced includes a greater amount of liquids and the overall downhole pressure continues to decline. Because the characteristics of the well may change drastically during the mature stage of production as compared to the early liquid loading stage, the time period that the well is shut in order to optimize production is different during the mature stage than it is for early liquid loading stage. In fact, the time period that the well is to be off in order to optimize well production may vary from cycle to cycle during the mature production stage. Thus, the well operator's familiarity with the well and past practices of shutting it in for optimum production may no longer apply during the mature stage of production. Furthermore, the liquid loading in the well may be so great during the mature stage that the plunger either floats on the liquid column in the well or stalls when the well is turned on if the well is not opened under the right conditions.

Accordingly, methods and apparatuses that optimize an oil and gas well while overcoming one or more of the aforementioned problems are desirable.

SUMMARY

While conventional well optimization schemes are based upon timing the shut in time of the well in relation to an operator's familiarity with the well and/or based upon a plunger's speed within the well, methods and apparatuses are disclosed for optimizing oil and gas wells that overcome one or more of the disadvantages of these conventional well optimization schemes. Some embodiments may include optimizing a gas well based upon continuous measurements of the well's operating parameters, such as casing pressure draw down and/or line pressure surges. These continuous measurements of the well's parameters may be utilized to derive an empirical model of the well's behavior that may be more accurate than conventional approaches with respect to the various stages of well production. In other words, by measuring the well's operating parameters continuously and measuring certain well parameters (like casing pressure draw down and/or surges in line pressure from opening the well), the empirical model derived therefrom may provide more accurate control of turn on criteria of the well than conventional approaches, such as during the mature production stage of production of the well.

Some embodiments include a system for optimizing a well comprising a controller and a plurality of sensing units coupled the well at various locations, where the controller monitors the plurality of sensing units and derives an empirical relationship between the well's opening criteria and at least one measurement from the sensing units.

Other embodiments include a method of optimizing a well, the method comprising scanning a plurality of sensors, determining a position of a control valve coupled to the well, and in the event that the control valve is substantially closed, calculating an optimum casing pressure at which to open the control valve, where the optimum casing pressure at which the control valve is opened is based on an empirically derived formula.

Still other embodiments include a controller for optimizing a well's production, the controller comprising a tangible storage medium for storing a plurality of instructions, the instructions including monitoring a plurality of sensors, storing a measurement associated with at least one of the plurality of sensors, estimating an opening casing pressure based on the measurement, determining if a casing pressure measurement from the plurality of sensors matches the estimated value, and in the event that the measured casing pressure matches the estimated value, opening the well.

Figure 1:
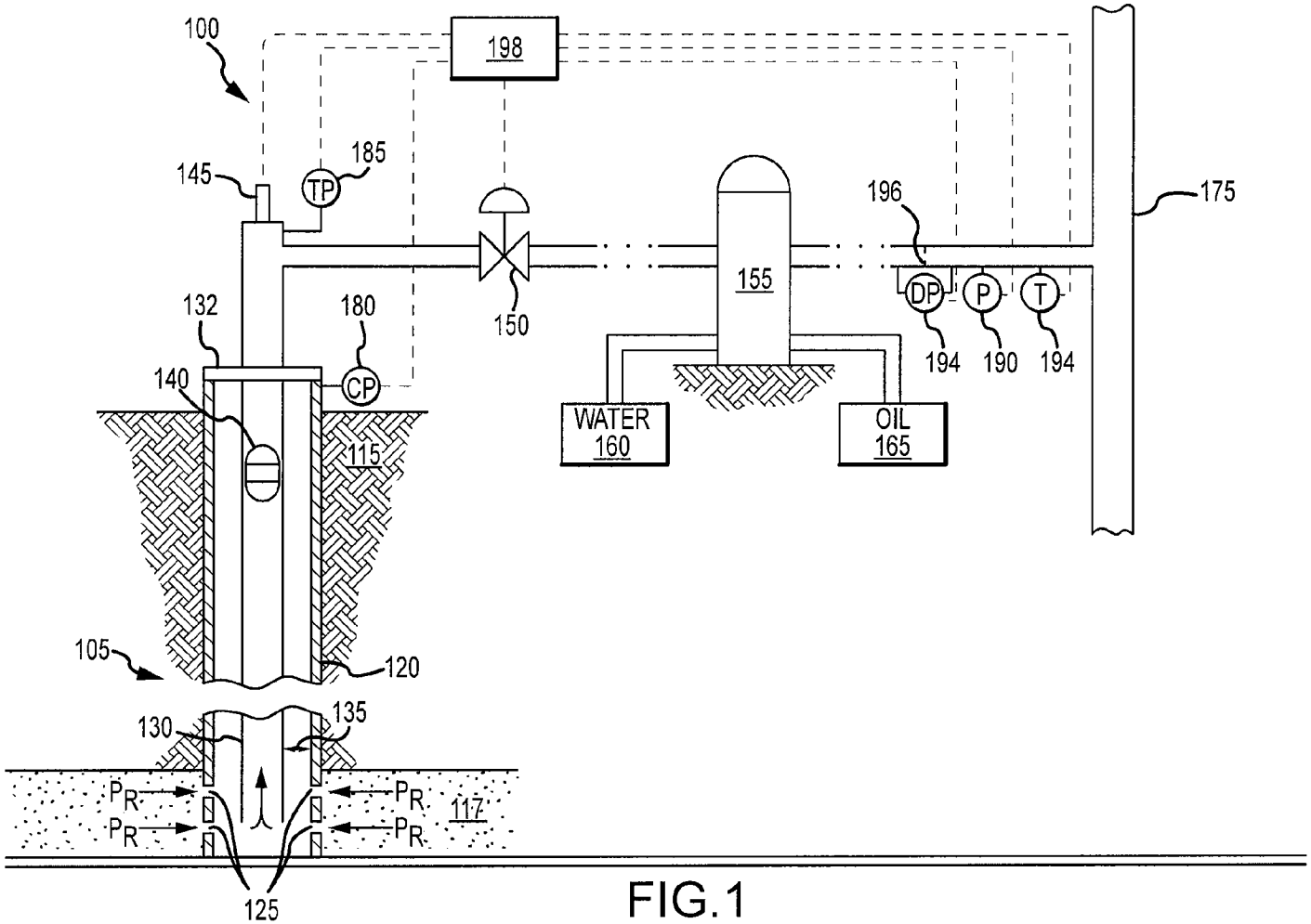
FIG. 1 illustrates a well capable of being optimized.

Appendix A illustrates a table including data sampled daily for a sample well measuring differential pressure, line pressure, line temperature, production determined by a remote terminal unit within the well, flow time, casing pressure, tubing pressure and liquid load.

Appendix B illustrates a table including data sampled every three minutes for a first month for a sample well, measuring the same data as Appendix A.

Appendix C illustrates table including data sampled every three minutes for a second month for sample well, measuring the same data as Appendix A.

The use of the same reference numerals in different drawings indicates similar or identical items.

DETAILED DESCRIPTION OF THE INVENTION

Although one or more of the embodiments disclosed herein may be described in detail with reference to a particular device, the embodiments disclosed should not be interpreted or otherwise used as limiting the scope of the disclosure, including the claims. In addition, one skilled in the art will understand that the following description has broad application. Accordingly, the discussion of any embodiment is meant only to be exemplary and is not intended to suggest that the scope of the disclosure, including the claims, is limited to these embodiments.

FIG. 1 illustrates a petrochemical well 100 capable of being optimized. It should be appreciated that while the well 100 is discussed herein in the context of a petrochemical well that produces hydrocarbons, the methods and apparatuses for optimizing the well 100 may equally apply to non-petrochemical wells. Furthermore, while the methods and apparatuses for optimizing the well 100 are discussed herein in the context of optimizing the gas production of the well 100, the methods and apparatuses for optimizing the well 100 may equally apply to optimizing oil production from the well 100. Additionally, while certain features of the well 100 are shown or may be described herein, more, less, and/or different features may be present.

Referring now to FIG. 1, the well 100 generally includes a wellbore 105 that is vertically drilled into a formation 115. Although the wellbore 105 is shown and described as being vertical in nature for convenience of discussion, it should be appreciated that the wellbore 105 may be non-vertical, for example, as a result of directional drilling techniques.

The formation 115 may include several strata that include petrochemical containing reservoirs of interest. For example, as shown in FIG. 1, the formation 115 may include a reservoir 117 that contains mixtures of oil and gas. After the wellbore 105 is drilled into the formation 115, a casing 120 is placed into the wellbore 105, where the casing 120 may include a group of perforations 125 situated about the wellbore 105 in the location of the reservoir 117. While FIG. 1 illustrates one group of perforations 125 for the sake of discussion, the casing 120 may include several groups of perforations 125 at various locations along the wellbore 105 so as to coincide with reservoirs of interest.

The well 100 may include production tubing 130 that conveys oil and gas to the surface for further processing. As shown, the tubing 130 is enclosed within the casing 120 beneath a wellhead 132 and exposed above the wellhead 132. The tubing 130 is generally smaller in diameter than the casing 120, and as a result, an annular void or cavity 135, referred to herein as the annulus 135, may be formed between the casing 120 and the tubing 130. Although not specifically shown in FIG. 1, a production packer may be placed in the annulus 135 near the end of the tubing 130 so as to provide a seal between the outside diameter of the tubing 130 and the inside diameter of the casing 120. In the embodiments that include a production packer, a hole may be drilled in the tubing 130 above the packer so that the annulus 135 may accumulate pressure when the well is shut in.

The tubing 130 may include a plunger 140 that is vertically moveable within the tubing 130. As will be described in greater detail below, when the tubing 130 fills with fluid form the reservoir 117, the plunger 140 may assist in clearing this fluid from the tubing 130. A plunger arrival switch 145 may be coupled to the end of the exposed portion of the tubing 130 to determine when the plunger 140 has reached the top of the tubing 130. In some embodiments, the plunger arrival switch 145 may operate by emanating a magnetic field and sensing changes in this magnetic field as the plunger 140 passes through the magnetic field to indicate it has arrived at the top of the tubing 130. Additionally, in some embodiments, the plunger 140 may be tethered to a cable or wire (not specifically shown in FIG. 1) such that the plunger 140 may be retrieved from the well 100 or the cable may be used to assist in clearing the well 100.

As shown in FIG. 1, the tubing 130 may couple to various surface side equipment in order to facilitate delivery of the oil and gas that is removed from the wellbore 105. Specifically, a control valve 150 that regulates oil and gas flow from the wellbore 105 may be coupled to the tubing 130. The actual implementation of the control valve 150 may vary between different embodiments. For example, in some embodiments, the control valve 150 may be a gas actuated control valve of the type disclosed in commonly owned Provisional U.S. Patent Application Nos. 61/094,274 and 61/094,485 and their Non-provisional U.S. patent application Ser. No. 12/552,630.

Production from the well 100 may be in the form of a liquid-gas mixture that includes a mixture of oil, gas, and water. The control valve 150 may flow this mixture to an inlet of a separator 155 where the mixture is separated into its constituent portions. A water holding tank 160 and an oil holding tank 165 may couple to outlets of the separator 155 to collect the unwanted portions of the mixture (e.g., water and oil). (As mentioned above, the well 100 may be optimized for its oil or water production rather than gas production, and therefore what is "wanted" versus "unwanted" may vary between embodiments.) The gas portion of the mixture may exit the separator 155 through an outlet coupled through a final section of piping 170 that is further coupled to a gas pipeline 175 for further refinement. It should be appreciated that the distance between the wellhead 132 and the pipeline 175 is not shown to scale in FIG. 1, and the actual distance between the wellhead 132 and the pipeline 175 may vary between embodiments. For example, in some embodiments, the distance between the wellhead 132 and the pipeline 175 may be around 75 feet, while in other embodiments, the distance between the wellhead 132 and the pipeline 175 may be thousands of feet.

As shown in FIG. 1, the well 100 also may include a plurality of gauges capable of measuring and/or reporting various well characteristics. Depending upon the embodiment, these gauges may be local devices with a visual output, or alternatively, they may be devices that transmit information to a controller (such as the controller 198 discussed below) and the controller transforms the transmitted data into another form for calculation purposes. On the wellhead 132 side, a casing pressure (CP) gauge 180 may couple to the casing 120 to monitor the pressure in the casing 120 and a tubing pressure (TP) gauge 185 may couple to the tubing 130 to monitor the pressure in the tubing 130. On the pipeline 175 side, a pressure gauge 190 may couple to the piping 170 to measure the pressure of the gas transmitted into the pipeline 175, which is sometimes termed "line pressure" (LP). A temperature gauge 192 may couple to the piping 170 to measure the temperature of the gas transmitted into the pipeline 175 and a pressure gauge 194 may measure the pressure in the piping 170 on either side of an orifice plate 196, sometimes termed "differential pressure" (DP). In some embodiments, the gauges 190, 192, and 194 may be combined into a single three-in-one gauge set.

The gauges 180, 185, 190, 192, and 194 may convey their measured values to a controller 198. The actual implementation of the controller 198 may vary between embodiments. For example, in some embodiments, the controller 198 may be a remote terminal unit (RTU), such as the FIELDHOUND™ VM-32 model available from CH2M Hill, and in other embodiments, the controller 198 may include a programmable logic controller (PLC) or general purpose computer configured to monitor the various gauges 180, 185, 190, 192, and 194. Furthermore, although the controller 198 is shown in FIG. 1 as a being a single unit in a single location is should be appreciated that the controller 198 may be implemented as multiple RTUs, PLCs, and/or computers at various locations about the well 100. For example, in the embodiments where the distance between the wellhead 132 and the pipeline 175 is too great to adequately connect the controller 198 to the various gauges 180, 185, 190, 192, and 194, either wired or wirelessly, then multiple controllers 198 may be implemented at the wellhead 132 and pipeline 175 sides of the well 100.

During the early liquid loading stage of the well 100, the situation downhole may be different than during the initial production stage. The pressure $P_R$ may be lower and the amount of water and oil in the produced gas may be lower. This early liquid loading stage may represent approximately 25-35% of the life of the well 100 and may be characterized by production of less than about 2 barrels of liquid (water and/or oil) per day. Thus, the separator 155 and water and oil holding tanks 160 and 165 may be used during the early liquid loading stage of production. Also, in order to clear out the liquid that accumulates in the wellbore 105 during the early liquid loading stage of production, the well 100 may be shut in to allow downhole pressure, which was drawn down during gas production, to accumulate. More specifically, the controller 198 may turn the control valve 150 off periodically such that the pressure $P_R$ may build up over time after being drawn down during production.

Referring still to FIG. 1, the operation and optimization of the well 100 will now be described. As mentioned above, the reservoir 117 may include mixtures of oil and gas, where the precise ratio of oil to gas may vary between different wells and also may vary over the lifetime of the well 100. During the initial production stage of the well 100. the downhole pressure of the reservoir 117, denoted as $P_R$ in FIG. 1, is sufficiently high such that gas in the reservoir 117 may enter the casing 120 through the perforations 125. As the casing fills with the gas, and the downhole pressure increases, the gas may begin to fill the tubing 130 where it travels up the tubing 130 to the control valve 150. In the initial production stage of gas production, the gas produced may be relatively high pressure dry gas such that the separator tank 155 and water and oil holding tanks 160 and 165 may be omitted. As such, the control valve 150 may be operated by the controller 198 such that the well 100 is on for longer periods of time than during the early liquid loading or mature production stages of the life of the well 100.

Without the separator tank 155, this relatively dry gas exerts a pressure on the wellhead 132 side of the orifice plate 196 such that the differential pressure DP may be measured by the gauge 194 as the gas travels to the pipeline 175. The line pressure LP and the temperature also may be measured by the gauges 190 and 194 respectively before the gas enters the pipeline 175. The measurements from the gauges 190, 192, and 194 may be used to calculate the flow rate through the orifice plate 196. For example, these measurements may be used to calculate flow rates according to the American Petroleum Institute (API) standard 21.1, which is often used to provide auditing information about the amount of gas transferred between the well owner and the gas supplier.

Notably, none of the conventional approaches, such as the API 21.1, measure the casing pressure CP or the tubing pressure TP in a continuous manner, such as once every second. Also, while conventional approaches, such as API 21.1, may provide for recording data once per second with regard to flow rate calculations, conventional approaches average this data on an hourly basis, and as a result, detailed information in the flow rate calculations are lost. As will be appreciated from inspection of field testing shown FIGS. 2A-2D, by taking detailed data with continuous measurements of casing pressure CP tubing pressure TP, differential pressure DP, and line pressure LP, detailed information about the operation of the well 100 may be observed and one or more empirical equations may be developed to based on these observations so as to more accurately optimize well production over conventional approaches.

Field testing was performed by making continuous measurements of the gauges 180, 185, 190, 192, and 194 on a well approximately 12,000 feet deep in the Cotton Valley of East Texas (hereinafter "the East Texas well"). These continuous measurements were then used to optimize the East Texas well. FIGS. 2A-2D illustrate various well parameters of the East Texas well over four subsequent on-and-off cycles of the East Texas well throughout a one day period, where continuous measurements of casing pressure CP tubing pressure TP, differential pressure DP, and line pressure LP were performed and then an empirical relationship was derived from these measurements and used to control the well for optimum production.

Figure 2A:
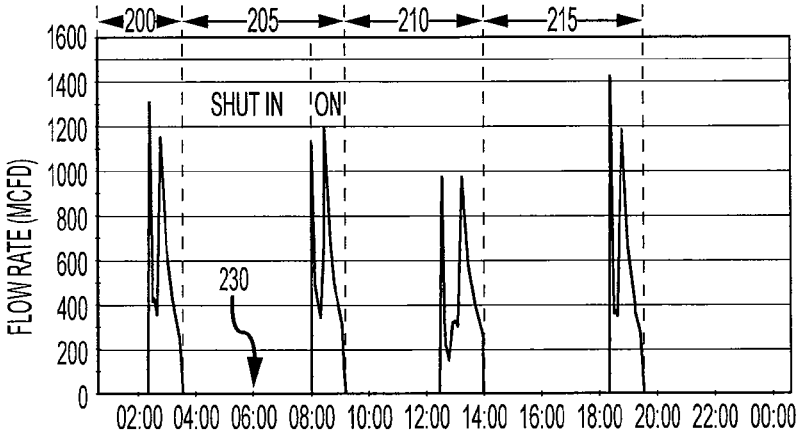
FIG. 2A illustrates a flow rate of the optimized well in thousands of cubic feet per day (MCFD).
Figure 2B:
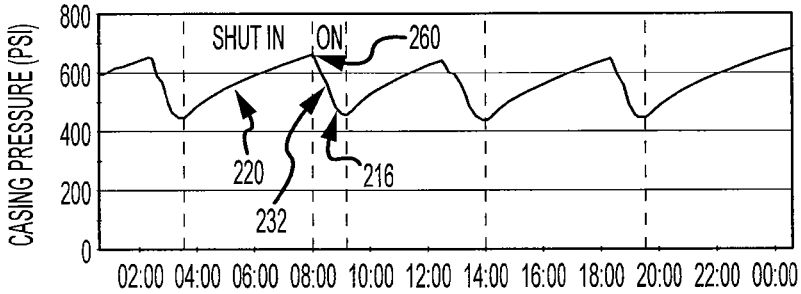
FIG. 2B illustrates a casing pressure CP of the optimized well in pounds per square inch.
Figure 2C:
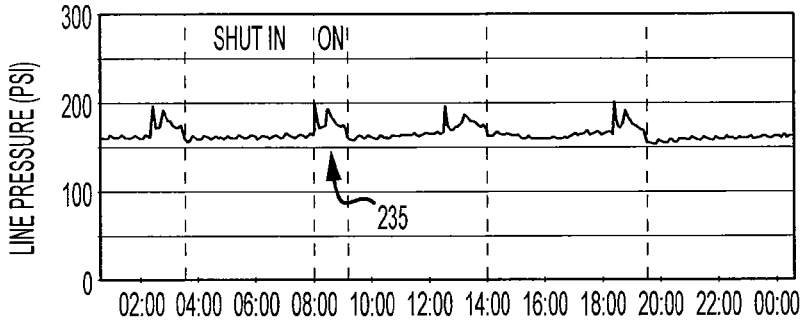
FIG. 2C illustrates a line pressure LP of the optimized well in pounds per square inch.
Figure 2D:
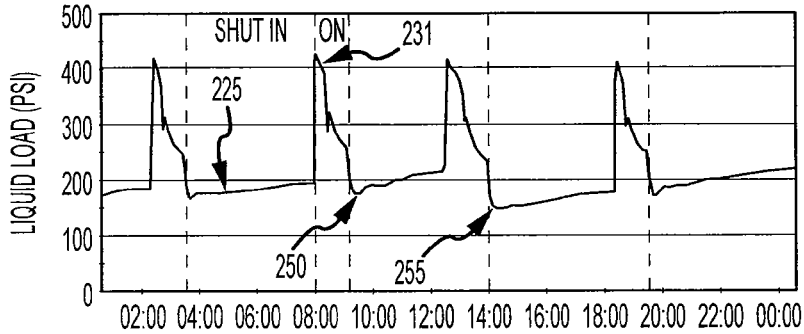
FIG. 2D illustrates a liquid load of the optimized well in pounds per square inch.

FIG. 2A illustrates the flow rate through the orifice plate 196, in thousands of cubic feet per day (MCFD), as calculated by measurements through the gauges 190, 192, and 194, where flow rate is shown on the ordinate axis and the time of the day corresponding to this flow rate is shown on the abscissa axis. FIG. 2B illustrates the casing pressure CP measured by the gauge 180 where the casing pressure CP, in pounds per square inch, is shown on the ordinate axis and the time of the day corresponding to this casing pressure CP is shown on the abscissa axis. FIG. 2C illustrates the line pressure LP measured by the gauge 190 where the pressure, in pounds per square inch, is shown on the ordinate axis and time of the day corresponding to that line pressure LP is shown on the abscissa axis. FIG. 2D illustrates the liquid load, as a function of casing pressure CP minus tubing pressure TP measured by the gauges 180 and 185, where the pressure, in pounds per square inch, is shown on the ordinate axis and the time of the day corresponding to this liquid load is shown on the abscissa axis.

Referring to FIG. 2A in conjunction with the well 100 shown in FIG. 1, there are four distinct production regions in the flow rate where the flow rate is non-zero. These four distinct production regions illustrate that the well 100 is being shut in and opened four times during a 24 hour period. The four on-and-off cycles of the well 100 are indicated by vertical dashed lines as cycles 200-215 in FIGS. 2A-2D. Referring to the cycle 205 in conjunction with FIG. 1, the well 100 is shut in by closing the control valve 150.

The well 100 may be shut in when the differential pressure DP measured across the orifice plate 196 reflects that the casing pressure CP is not large enough to overcome the inertia presented by the combination of the pressure of the tubing from the wellhead 132 to the control valve 150, through the separator 155, and out to the pipeline 175. When there is not enough casing pressure CP stored in the annulus 135 and/or formation pressure $P_R$ to overcome this inertia, the well 100 will be shut in. The casing pressure at which the well is shut in $CP_{SHUT\text{-}IN}$ is indicated with an arrow 216 in FIG. 2B. Note that shut in occurs four times as indicated by the dips in casing pressure CP, which are akin to the dip indicated by arrow 216. This shut in pressure $CP_{SHUT\text{-}IN}$ may vary depending upon the sizing of the orifice plate 196. For example, in some embodiments, the orifice plate may be 0.75 inches for a 3 inch pipeline and the casing pressure $CP_{SHUT\text{-}IN}$ at which the well 100 is shut in may correspond to 10 inches of differential pressure DP as measured across the orifice plate 196. In this example, the unit of measure is "inches" of water column (WC), where one pound per square inch (PSI) equals 27.67 inches of water. Thus, in this example, if the pressure across the orifice plate 196 were to drop below 10 inches, then due to the size of the orifice in the orifice plate 196, there may be insufficient pressure difference on either side of the orifice plate for the controller 198 to perform a gas flow rate calculation and gas production from the well 100 may go unaccounted unless the well 100 is shut in when the differential pressure DP reaches this shut in criteria.

After the well is shut in, the casing pressure CP starts to build up as shown by the arrow 220. Referring to FIG. 2D, the "static" liquid load, or casing pressure CP minus tubing pressure TP during shut in, begins to increase because the casing pressure CP is increasing (this is illustrated with the arrow 225). Furthermore, referring to FIG. 2A, during shut in, the production from the well 100 is substantially zero, and therefore the flow rate is substantially zero as shown by the arrow 230.

When the well 100 is opened up during the cycle 205, the "dynamic" liquid load (shown in FIG. 2D) spikes as shown by the arrow 231 and the casing pressure CP (shown in FIG. 2B) begins to decrease as shown by the arrow 232. The situation where the casing pressure CP decreases while the well 100 is on is known as casing pressure "draw down". Conventional approaches, such as those described in Foss, D. L. and Gaul, R. B., "Plunger-Lift Performance Criteria with Operating Experience—Ventura Avenue Field", Drilling and Production Practices, API, 1965, 124-140 (hereinafter "Foss and Gaul") assume that the reservoir 117 has enough pressure to replenish this casing pressure CP during draw down, and therefore do not account for casing pressure draw down using continuous measurements. As will be described in further detail below, by continuously measuring casing pressure CP draw down and accounting for it, an empirical model may be developed to further optimize production of the well over conventional approaches.

Also, when the well 100 is opened up during the cycle 205, there is a surge in line pressure LP due to the well 100 being opened. This is indicated in FIG. 2C with arrow 235. Conventional approaches, such as Foss and Gaul, also do not account for this surge in line pressure LP. Akin to casing pressure CP draw down, by continuously measuring line pressure LP and accounting for it, an empirical model may be developed to further optimize production of the well over conventional approaches.

Figure 2E:
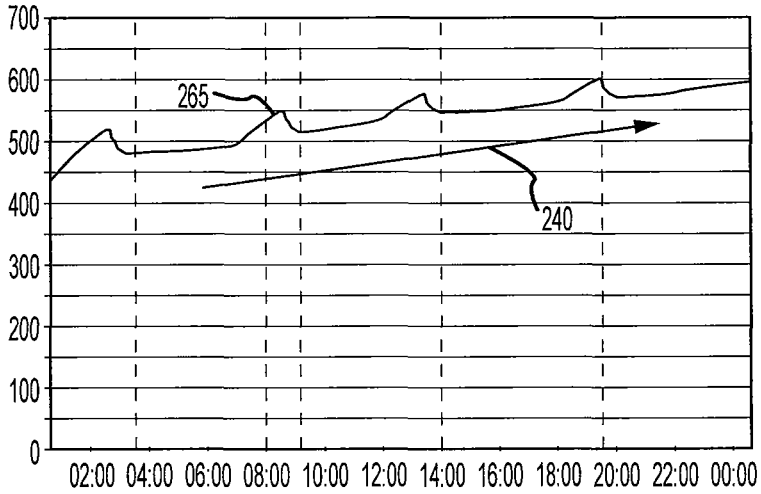
FIG. 2E illustrates a casing pressure CP of an non-optimized well in pounds per square inch.
Figure 2F:
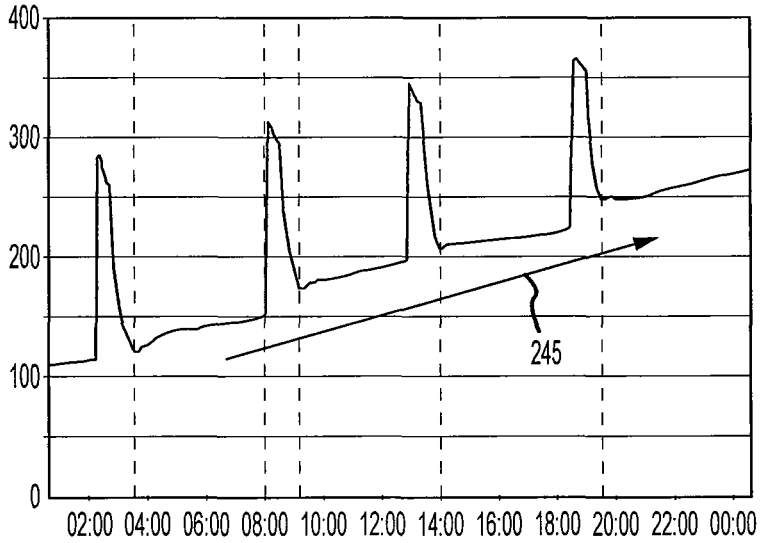
FIG. 2F illustrates a liquid load of an non-optimized well in pounds per square inch.

During shut in, the plunger 140 may fall in the tubing 130. (However, as described above, the plunger 140 may never reach the bottom of the tubing 130). To clear liquid from the wellbore 105, the controller 198 may open the well 100 by actuating the control valve 150 once the casing pressure CP is great enough for the plunger 140 to lift the liquid load to the surface of the well 100 where it is separated by the separator 155. By not timing the turn on of the well 100 properly, the liquid load in the well 100 will accumulate. This was observed during the field tests in the East Texas well mentioned above when the well was not optimized as disclosed herein. FIGS. 2E and 2F illustrate this condition at arrows 240 and 245 where there is an overall upward trend for casing pressure CP (FIG. 2E) and liquid load (FIG. 2F), indicating that there is a net increase of liquid in the well 100 at the end of each cycle. Contrast this with the liquid load shown in FIG. 2D where the well 100 has been optimized by accounting for casing pressure CP draw down and line pressure LP surges. For example, referring to FIG. 2D, at the beginning of the cycle 215 (indicated by the arrow 250) the static liquid load is less that the static liquid load at the beginning of the cycle 210 (indicated by the arrow 255). Thus, by not analyzing the measurements from the well 100 at the correct level of detail, conventional approaches may fail to unload the liquid from the well and/or fail to produce as much gas from the well 100 as may be possible by continuously measuring characteristics of the well 100.

The field tests of the East Texas well for optimized conditions (shown in FIGS. 2A-2D) and non-optimized conditions (FIGS. 2E and 2F) illustrate that substantial gains in the production of the well 100 are possible by optimizing the well as disclosed herein. Table 1 illustrates the production gains that were observed by optimizing the East Texas well. As shown in Table 1, the daily production of the optimized well showed an increase of 18.4 MCFD more production than the non-optimized well. This is notable because the line pressure LP was actually greater during the period of optimized operation than during the period of non-optimized operation. In other words, the optimized well was able to achieve 18.4 MCFD more production despite the pipeline 175 exerting another 20.8 PSI of pressure back on the well during the optimized period than during the non-optimized period. Furthermore, Table 1 shows that the optimized well unloaded an additional 9.4 pounds of liquid load versus the non-optimized well. This was illustrated above in FIGS. 2D and 2F where the liquid load is increasing (per arrow 245) in the non-optimized well and the liquid load is decreasing (per arrows 250 and 255) in the optimized well. Unloading additional liquid in this manner may allow the lifetime of the well to be extended.

TABLE 1

| | OPTIMIZED | NON-OPTIMIZED |
|---|---|---|
| Daily Production (MCF) | 121.5 | 103.1 |
| Average Line Pressure (PSI) | 164.9 | 144.1 |
| Average Liquid Load (Pounds) | 214.1 | 204.7 |

This optimum production from the well 100 may be achieved by making continuous measurements of the well 100, including casing pressure CP and line pressure LP, and then determining when the casing pressure CP is sufficient to overcome the liquid load in the wellbore 105 and turning the well 100 back on at this time. Because both the casing pressure CP varies with time and the liquid load in the tubing 130 varies with time, optimizing well production can be difficult. Conventional approaches attempt to time the on and off time of the well 100 based upon the plunger's 140 speed in the tubing 130. The speed of the plunger is calculated based upon assuming that after a sufficient amount of time, the plunger 140 will sink to the bottom of the tubing 130, and that after the tubing 130 is unloaded, the plunger 140 will be detected at the top of the tubing 130 by the plunger arrival switch 145. If the plunger 140 never reaches the bottom of the tubing 130 during shut in, however, then this speed calculation may be incorrect and the well 100 may have a net increase in liquid load as shown in FIG. 2F. Thus, conventional approaches that control shut in and turn on of the well based upon plunger speed do not optimize the production of the well 100 properly.

The deficiencies of conventional approaches are even more pronounced during the mature stage of production where liquids produced from the well 100 are greatest—e.g., between about 2 barrels to about 30 barrels of liquid per day. The mature stage of production includes approximately 50-70% of the life of the well 100, and thus optimizing the well as disclosed herein may substantially improve the production of the well.

Embodiments of the invention may optimize the well 100 more efficiently than conventional approaches by continuously monitoring data from one or more of the gauges 180, 185, 190, 192, or 194. For example, embodiments of the invention may optimize the well 100 by measuring each of the gauges 180, 185, 190, 192, and 194 more frequently than what is required by the AGA 21.1 standard, such as every second in some embodiments. Based on these more frequent measurements, the particular behavior of the well 100 may be profiled to empirically determine the relationship between the amount of liquid load in the well 100 and the optimum casing pressure $CP_{OPEN}$ at which to turn the well 100 on in order to unload the liquid from the well 100. The liquid load in the well 100 may be related to the difference between the casing pressure CP and the tubing pressure TP. For example, Equation (1) illustrates the static liquid load X of the well 100 during the shut in period as the difference between casing pressure CP and tubing pressure TP.

$$X=CP-TP \tag{1}$$

In order to characterize the well 100, the opening casing pressure $CP_{OPEN}$ may be continuously measured and the static liquid load X at those opening pressures $CP_{OPEN}$ may be measured while holding the line pressure LP measurement constant. The opening casing pressure $CP_{OPEN}$ is shown in FIGS. 2B and 2E as arrows 260 and 265 respectively. By characterizing the well 100 in this manner, an empirical relationship between static liquid load X and the opening casing pressure $CP_{OPEN}$ may be determined. During this characterization period of the well 100, the line pressure LP measurement may be held constant by turning off a valve positioned between the pipeline 175 and the pressure gauge 190, or by having the controller 198 nullify its measurement. Also, during this characterization period, the plunger 140 weight is assumed to be zero. These two assumptions will be accounted for below when deriving the relationship for opening casing pressure $CP_{OPEN}$ (see Equation (3) below).

Figure 3:
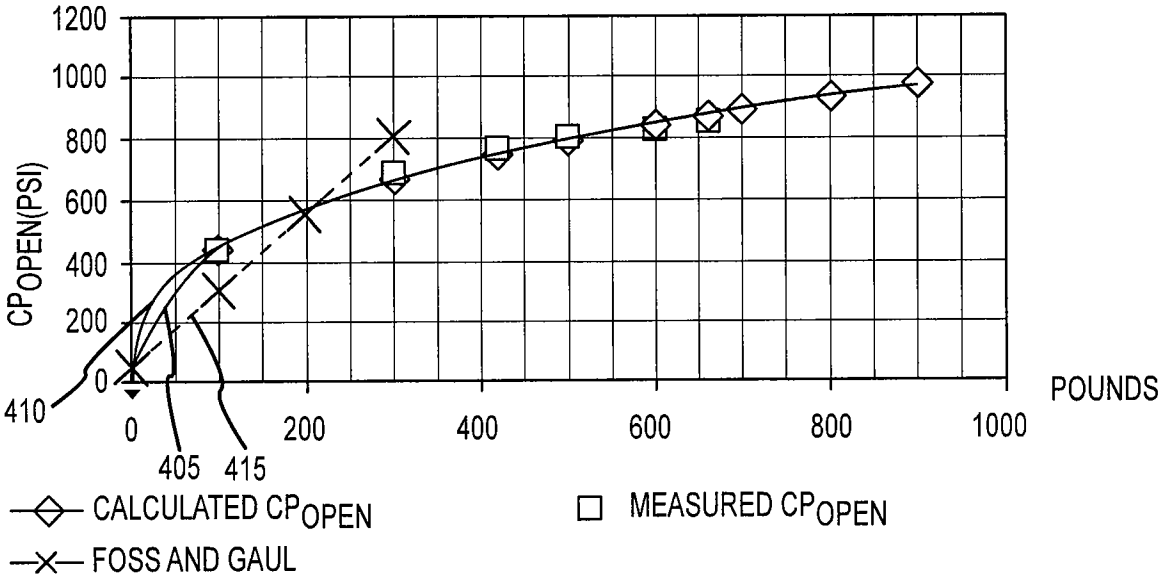
FIG. 3 illustrates empirical models for determining an optimum opening casing pressure.

FIG. 3 illustrates the relationship between the continuous measurements for casing pressure $CP_{OPEN}$ versus liquid loads X varying between 100 pounds and 700 pounds (while holding the pipeline 175 pressure LP constant) as a curve 405. Curve 405 is differentiated from the other curves in FIG. 3 by having squares at one or more of the continuously measured casing pressure $CP_{OPEN}$ points. Based upon these measurements, an empirical estimation may be derived as illustrated in Equation (2), where Y represents the net force at the wellhead 132 or the difference between the casing pressure CP and the line pressure LP as measured by the gauge 190 (where this value may be held constant for derivation purposes), X is the static liquid load from Equation (1), and K and i are constants that are derived based upon the continuous measurements.

$$Y=K\cdot X^{i} \tag{2}$$

FIG. 3 illustrates the empirically derived behavior between casing pressure $CP_{OPEN}$ and liquid load X from Equation (2) as a curve 410. Curve 410 is differentiated from the other curves in FIG. 3 by having diamonds at one or more of its calculated points. In some embodiments, the curve 410 may be derived by linear regression, however, other embodiments may utilize alternative mathematical methods. This linear regression method may yield various values for the constants K and i, where i controls the shape of the curve and K may scale the curve. For example, based upon the field tests of the East Texas well shown in FIGS. 2A-2D, the linear regression methods derived these values as K=87.547288 and i=0.34458. These values for K and i were used in the curve 410. It is believed that substituting these values for K and i into Equation (2) will mathematically characterize behavior of numerous well's for casing pressure $CP_{OPEN}$ versus liquid load X. This is shown in FIG. 3 by the curve 410 substantially matching the curve 405.

Other embodiments, however, may derive different values for K and i. For example, if the reservoir's 117 geological characteristics change significantly, because a portion of the well 100 caves in, then the actual values for K and i may vary. In these embodiments, the controller 198 may continuously measure the measurements of the well 100 (via gauges 180, 185, 190, 192, and/or 194) and derive updated values for K and i. For example, in some embodiments, the measurements of the well 100 are continuously monitored every second and the trends of the well 100 over time are derived every second.

FIG. 3 also shows a curve 415, which illustrates conventional approximations of the behavior of casing pressure $CP_{OPEN}$ versus liquid load X as outlined by Foss and Gaul. The Foss and Gaul curve 415 is differentiated from the other curves in FIG. 3 by having Xs at one or more of its calculated points. While Foss and Gaul may account for some of the measurements of the well 100, it fails to account for casing pressure CP draw down (shown and described above in the context of FIG. 2B) and/or the friction caused by the surges in the line pressure LP (shown and described above in the context of FIG. 2C). As a result of failing to account for casing pressure CP draw down and/or the line pressure LP surges, it is believed that the Foss and Gaul model incorrectly characterizes the behavior of the well 100 as a linear relationship per the curve 415. Instead, empirical results based upon continuous measurement of the parameters of the well 100, shows this behavior as a non-linear power function per Equation (2). However, other embodiments are possible where the function may be a hyperbolic expression. Furthermore, the deficiencies between the Foss and Gaul model and the relationship established by Equation (2) are believed to be more prominent during the mature stage of the life of the well 100.

Figure 4:
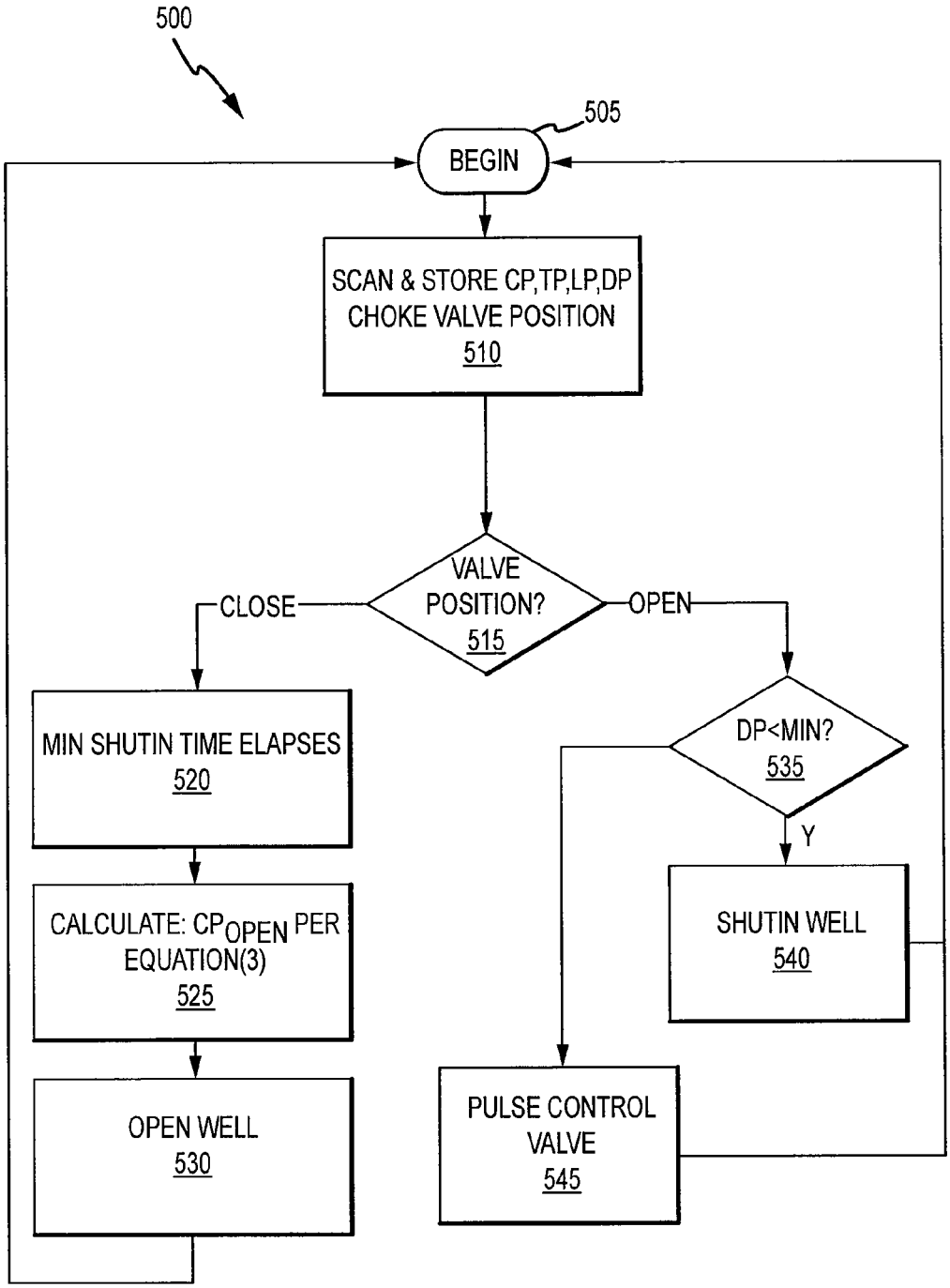
FIG. 4 illustrates operations that may be performed in optimizing a well according to an empirically derived model for determining an opening casing pressure.

FIG. 4 illustrates operations 500 that may be performed by the controller 198 while optimizing the production of the well 100 according to Equation (2) in addition to accounting for the line pressure LP and the plunger's 140 weight per Equation (3).

$$Y=LP+\text{plungerweight}+K\cdot X^{i} \quad (3)$$

The operations 500 begin at block 505 and move to block 510 where the controller 198 may scan one or more of the gauges 180, 185, 190, 192, and/or 194 in order to determine their current values. As mentioned above, the block 510 may be performed such that continuous measurements may be made either by repeating the block 510 alone or by repeating the block 510 in conjunction with the operations 500. Regardless of the actual implementation, in some embodiments, the operation of scanning the gauges 180, 185, 190, 192, and/or 194 per block 510 may be performed at least once every second. The controller 198 optionally may store the values of the casing pressure CP, tubing pressure TP, pipeline pressure LP, and/or differential pressure DP as part of the operation shown in block 510.

Control may flow from block 510 to block 515 where the position of the control valve 150 may be determined. In the event that the control valve is closed, then control may flow to block 520 where the minimum shut in time elapses that will allow the plunger to reach the bottom of the tubing 130. The minimum shut in time may be calculated as the length of the tubing 130, or depth of the well 100, divided by an estimated speed of the plunger 140. Although the plunger 140 may not reach the bottom of the tubing 130, and the estimation of the plunger's 140 speed may be inaccurate, by iteratively performing the operations 500, the well 100 may be optimized without regard to the plunger's 140 speed. Thus, determining the minimum shut in time per block 520 may serve as an initial estimate of the shut in time that serves as a starting point for optimizing the well. From this starting point, Equation (3) may be applied to the data iteratively per block 525.

With the opening casing pressure $CP_{OPEN}$ calculated per Equation (3), then as continuous measurements are made by the controller 198, if the calculated opening casing pressure $CP_{OPEN}$ is reached then the well may be opened per block 530 and control may flow back to block 505 where the status of the control valve 150 is again checked per block 515 after scanning and storing the measurements of the well 100 per block 510.

Referring again to the decision in block 515, in the event that the control valve 150 is open, for example, in the event that the calculated opening casing pressure $CP_{OPEN}$ has been obtained, control may flow to block 535. In block 535, the differential pressure DP may be checked to determine if it is less than a minimum differential pressure DP of the orifice plate 196, and if the differential pressure DP is less than this minimum, then the well 100 may be shut in per block 540. As mentioned above, the orifice plate 196 may be optimally sized according to the well 100, and therefore the minimum differential pressure DP at which the well 100 will shut in per block 540 may vary between embodiments. In some embodiments, the minimum differential pressure DP for shut in may be 10 inches.

If, on the other hand, the differential pressure DP is not less than the minimum per block 535, then the control valve 150 may be pulsed or intermittently actuated in order to optimize the differential pressure DP according to real time well conditions as measured continuously. Control valves capable of achieving this optimization are disclosed in commonly owned U.S. Patent Application Nos. 61/094,274 and 61/094,485 and their Non-provisional U.S. patent application Ser. No. 12/552,630.

Figure 5B:
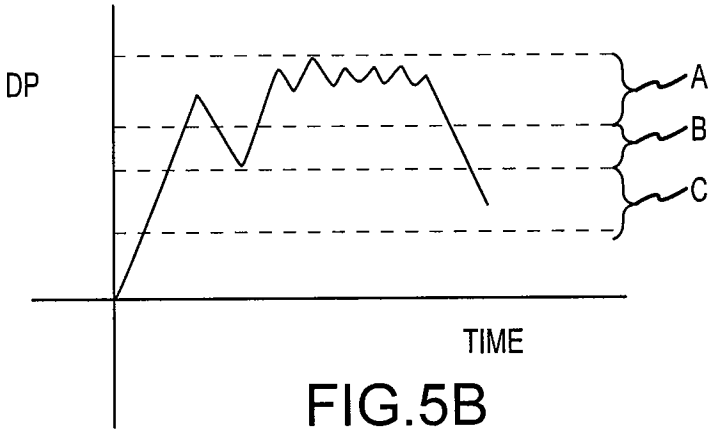
FIG. 5B illustrates optimizing the differential pressure shown in FIG. 5A.
Figure 5A:
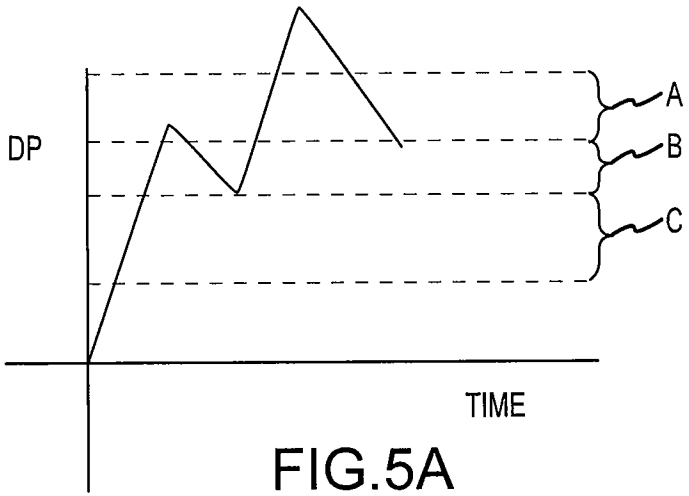
FIG. 5A illustrates the differential pressure of an optimized well.

FIGS. 5A and 5B illustrate this optimization. Referring to FIG. 5A, a non-optimized well is shown where time is on the abscissa axis and the differential pressure DP through the control valve 150 is shown on the ordinate axis. The horizontal dashed lines refer to the various sizes of orifice plates 196 A-C that may be implemented in the well 100. Assuming that size A of the orifice plate 196 is implemented, then instead of letting the differential pressure DP overshoot the differential pressure range of the orifice plate 196, the gas production may be optimized by pulsing the control valve 150 to produce gas within the range of the orifice plate 196 as shown in FIG. 5B. Again, this optimization may be based on continuous differential pressure DP measurements as taken by the controller 198 during the optimization operations 500. Once this pulsing has occurred per block 545, control may flow back to block 505, where the optimization operations 500 may be repeated and trended with previous optimization operations. For example, as mentioned above, in some embodiments, the measurements of the well 100 are continuously monitored every second and the trends of the well 100 over time may be derived every second.

Referring back to FIG. 4, once the control valve 150 is pulsed to achieve a differential pressure DP within the range of the orifice plate 196 per block 545, then control may flow to block 505 where one or more of the operations 500 may be repeated.

Appendices A, B and C illustrate tables including data collected for a sample well measuring differential pressure, line pressure, line temperature, production determined by a remote terminal unit (RTU) within the well, flow time, casing pressure, tubing pressure and liquid load. Appendix A lists the data as measured once a day for two months, Appendix B lists the data measured every three minutes for a first month, and Appendix C lists the data measured every three minutes for a second month. As illustrated in Appendix B (and subsequently reflected in Appendix A), on Jul. 17, 2010 at 16:00 hours, embodiments of the systems and/or methods disclosed herein were deactivated. A conventional "timer controller" was then activated. As can be seen from Appendices A and B, there was a drop (as compared to surrounding time and day data) in the sample well's production (determined by the RTU), as well as corresponding drop in differential pressure and liquid load. However, as also illustrated in Appendices A and B, on July 27, 10:00 hours, embodiments of the systems and/or methods were activated and the conventional "time controller" was deactivated. Once the embodiments of the system and/or methods of the disclosure were activated, the sample well's production (determined by the RTU) as well as the differential pressure and liquid load significantly increased. Thus, as shown in the data collected in Appendices A, B and C, the disclosure herein may significantly increase and/or affect a well's production and other related variables.

Although examples of this invention have been described above with a certain degree of particularity, those skilled in the art could make numerous alterations to the disclosed embodiments without departing from the spirit or scope of the invention as described in the specification, drawings and claims. It is intended that all matter contained in the above description or shown in the accompanying drawings shall be interpreted as illustrative only and not limiting. Changes in detail or structure may be made without departing form the spirit of the invention as defined in the appended claims.

What is claimed is:

1. A system for optimizing a well comprising:

a controller; and a plurality of sensing units coupled the well at various locations;

wherein the controller monitors the plurality of sensing units and derives a non-linear empirical relationship between the well's opening criteria and at least one measurement from the sensing units, and the non-linear empirical relationship is substantially of the form $K \cdot X^i$, where X is a static liquid load, and K and i are constants derived at least in part from the at least one measurement, and the controller is configured to open the well responsive to a measurement from the plurality of sensing units matching an optimum casing pressure derived from the non-linear empirical relationship.

2. The system of claim 1, further comprising a casing, wherein the controller monitors a casing pressure sensing unit within the plurality that is coupled to the casing.

3. The system of claim 2, further comprising a pipeline, wherein the controller monitors a pipeline pressure sensing unit within the plurality that is coupled to the pipeline.

4. The system of claim 3, wherein the non-linear empirical relationship is based upon measurements from both the casing pressure sensing unit and the pipeline pressure sensing unit.

5. The system of claim 4, wherein the controller monitors the plurality of sensing units continuously.

6. The system of claim 1, wherein the non-linear relationship also accounts for a line pressure and a weight of a plunger.

7. A method of optimizing a well, the method comprising the acts of:

scanning a plurality of sensors;

determining a position of a control valve coupled to the well;

in the event that the control valve is substantially closed, calculating an optimum casing pressure at which to open the control valve; and opening the well responsive to a casing pressure measurement from the plurality of sensors matches the optimum casing pressure wherein the optimum casing pressure at which the control valve is opened is based on an empirically derived formula that includes at least the term $K \cdot X^i$, where X is a static liquid load, and K and i are constants derived at least in part from measurements made by scanning the plurality of sensors.

8. The method of claim 7, wherein the act of scanning occurs continuously.

9. The method of claim 7, wherein the plurality of sensors scanned include a casing pressure sensor and a pipeline pressure sensor.

10. The method of claim 7, further comprising the act of allowing a minimum shut in time to elapse in the event that the control valve is substantially closed.

11. The method of claim 7, wherein the act of scanning the plurality of sensors further comprises the act of trending the values of at least one sensor in the plurality.

12. The method of claim 7, wherein the empirically derived formula also includes terms representative of a line pressure and a weight of a plunger.

13. A controller for optimizing a well's production, the controller comprising:

a tangible storage medium for storing a plurality of instructions, the instructions including:

monitoring a plurality of sensors;

storing a measurement associated with at least one of the plurality of sensors;

estimating an opening casing pressure based on an empirical formula substantially of the form $K \cdot X^i$, where X is a static liquid load, and K and i are constants derived at least in part from the stored measurement;

determining if a casing pressure measurement from the plurality of sensors matches the estimated value; and in the event that the measured casing pressure matches the estimated value, opening the well.

14. The controller of claim 13, wherein the measurement associated with at least one of the plurality of sensors includes a line pressure measurement.

15. The controller of claim 13, wherein the measurement associated with at least one of the plurality of sensors includes a differential pressure and the instructions stored on the tangible storage medium further comprising turning the well off in the event that differential pressure is less than a threshold value.

16. The controller of claim 13, wherein in the event that the well is opened, the instructions stored on the tangible storage medium further comprise pulsing a control valve.

17. The system of claim 13, wherein the controller monitors a casing pressure sensing unit within the plurality of sensors.

18. The system of claim 17, wherein the controller monitors a pipeline pressure sensing unit within the plurality of sensors.

19. The system of claim 18, wherein the empirical relationship is based upon measurements from both the casing pressure sensing unit and the pipeline pressure sensing unit.

20. The system of claim 19, wherein the controller monitors the plurality of sensing units continuously.

* * * * *